United States Patent [19]

Homery

[11] 4,064,729

[45] Dec. 27, 1977

[54] METAL FORMING DEVICE

[76] Inventor: Alex Homery, 3324 NW. S. River Drive, Miami, Fla. 33142

[21] Appl. No.: 773,517

[22] Filed: Mar. 2, 1977

[51] Int. Cl.[2] ..... B21C 25/00; B21B 15/00; B21C 35/02; B65H 37/00

[52] U.S. Cl. ..... 72/256; 72/257; 72/206; 72/220; 226/24; 226/188; 425/385

[58] Field of Search ..... 72/253, 256, 257, 206, 72/210, 220, 366; 425/385, 396; 226/24, 188

[56] References Cited

U.S. PATENT DOCUMENTS

| | | | |
|---|---|---|---|
| 962,058 | 6/1910 | Schwieger | 72/254 |
| 1,696,983 | 1/1929 | Taylor | 72/206 |
| 3,001,764 | 9/1961 | Worlidge | 72/256 |
| 3,010,575 | 11/1961 | Smith | 72/256 |
| 3,825,390 | 7/1974 | Heilmayr et al. | 425/385 |
| 3,851,510 | 12/1974 | Reth | 72/12 |
| 4,033,573 | 7/1977 | Wortman | 226/188 |

FOREIGN PATENT DOCUMENTS

| | | | |
|---|---|---|---|
| 944,949 | 12/1963 | United Kingdom | 72/256 |
| 402,317 | 11/1933 | United Kingdom | 72/256 |

*Primary Examiner*—C.W. Lanham

*Assistant Examiner*—D. M. Gurley

[57] ABSTRACT

A device for achieving a continuous forming of a metal rod or bar as it emerges from an extruder to impart desired repeating design characteristics therealong. The device includes a pair of co-acting motor driven forming rollers with complementary design portions formed in their engaging peripheral surfaces to engage the rod therebetween and to impart the forming roller design thereto. The forming rollers and variable speed drive motor are mounted on a carriage trolley movable on a track toward and away from the extruder in alignment with the extrusion emerging therefrom. The piston rod of a pneumatic piston and cylinder assembly is fixed to the carriage to impart a predetermined degree of pressure thereto in alignment with and in the same direction as the pressure forces of the metal rod extrusion. The drive motor is operated at a predetermined R.P.M. to create a condition whereby the driven forming rollers engagement with the extrusion substantially counterbalances the combined P.S.I. forces of the extrusion and piston rod permitting the trolley carriage to drift back-and-forth on the track in accordance with normal fluctuating P.S.I. forces of the extrusion without imparting deforming forces to the extrusion.

15 Claims, 6 Drawing Figures

METAL FORMING DEVICE

FIELD OF THE INVENTION

The present invention pertains to a metal forming device and, more particularly, to a device of this nature which is used to impart a continous repeating design along the length of a metal rod as it emerges from an extruder.

BACKGROUND OF THE PRESENT INVENTION

In the past the greatest difficulty encountered in imparting continuous repeating designs along the lengths of metal rods as they emerge from an extruder has arisen from the relatively soft condition of the metal in combination with the various forces to which they are subjected in emerging from the extruder and being formed.

Extrudable metals such as aluminum and aluminum alloys are often used in the manufacturing of metal furniture, particularly for outdoor use as well as for a wide variety of other uses. Rods of this nature are formed to simulate wrought iron, bamboo, etc., and when properly painted it is often difficult to determine which is the "real thing" and which is a simulation without making a close inspection.

The metal rods emerge from the extruder for forming at a temperature generally in the range of 800° to 900° F. Consequently, they are quite soft and easily deformable. The extruding P.S.I. is manually controllable but generally only within certain ranges. For example, the P.S.I. in a single manual setting may fluctuate between 6 and 12 P.S.I. When a pair of forming rollers are securely positioned relative to the extruder to receive the extrusion for the forming operation and the extrusion P.S.I. fluctuates to the above mentioned degree, the extrusion generally becomes deformed, either buckling or stretching out.

The present invention provides means to compensate for or to counter the P.S.I. fluctuations which results in the elimination of the waste encountered with the presently used forming devices.

Therefore, one of the principal objects of the present invention is to provide the forming rollers and their variable speed drive motor on a trolley carriage, engaged on tracks, for movement toward and away from the extruder with the forming rollers always disposed in engaged alignment with the emerging metal extrusion.

Another principal object of the present invention is to provide means such as a pneumatic piston and cylinder assembly connecting between a fixed position and the trolley carriage to exert a constant predetermined P.S.I. against the carriage trolley in the same direction as the extrusion forces.

A further object of the present invention is to operate the forming roller drive motor at a predetermined R.P.M. to counter the combined P.S.I. of the extrusion and the pneumatic piston and cylinder assembly whereby the carriage trolley drifts forwardly and backwardly in response to the fluctuating P.S.I. of the extrusion, thereby eliminating the buckling and/or stretching deformations resulting from the operation of forming rollers in a fixed position.

DETAILED DESCRIPTION OF THE DRAWINGS

Figure 1:
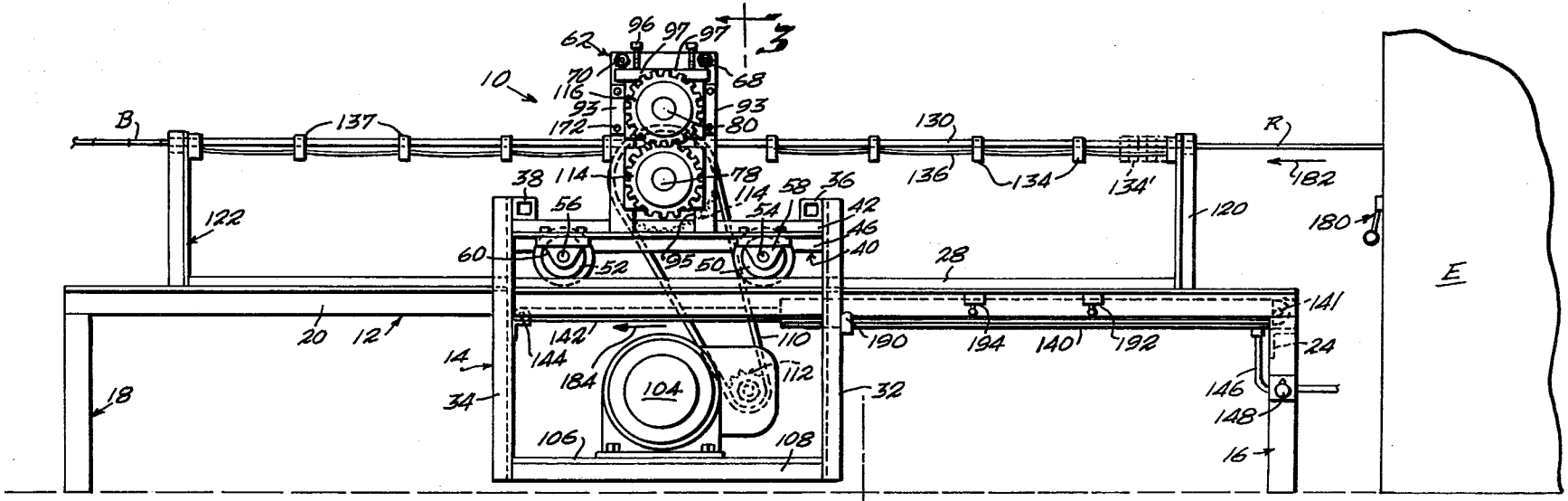
FIG. 1 is a side elevational view of the metal forming device of the present invention.

With reference to the drawings in which like reference characters designate like or corresponding parts throughout the various views, the numeral 10 generally designates the metal forming device of the present invention which includes a fixed frame 12 and a movable carriage trolley frame 14. Fixed frame 12 includes pairs of front and back legs 16 and 18 and a pair of longitudinally extending parallel top rails 20 and 22 connecting between the top ends of the respective pairs of legs 16 and 18. Transverse top end rails 24 and 26 connect respectively between the front and rear ends of the rails 20 and 22 and a pair of parallel trolley rails 28 and 30 are fixed as by welding generally along the lengths of the respective top rails 20 and 22.

Figure 3:
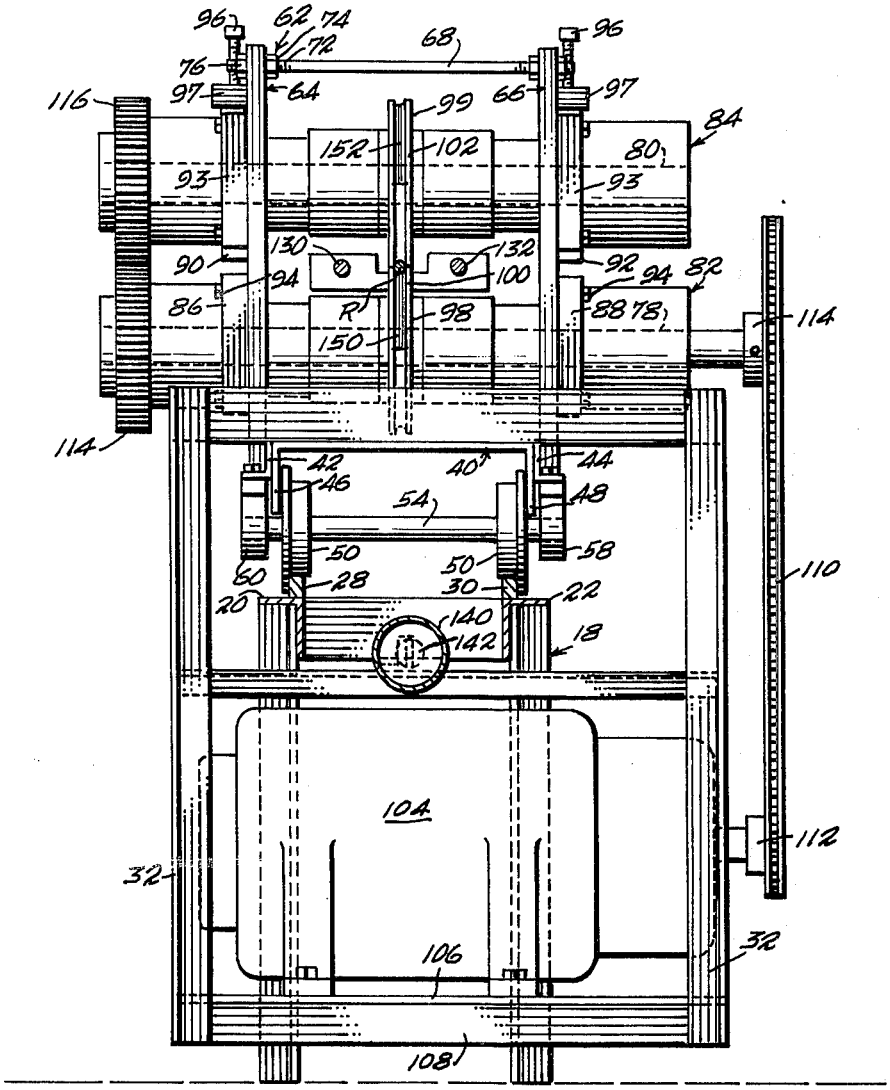
FIG. 3 is a vertical transverse sectional view taken along line 3—3 of FIG. 1.

The carriage frame 14 defines a generally cubical configuration including pairs of front and back, parallel, vertical rails 32 and 34. Transverse top rails 36 and 38 connect between the respective pairs of vertical rails 32 and 34, and an enlarged inverted generally channel shaped member 40, FIG. 3, is fixed as by welding in a spanning relation between the front and back top rails 36 and 38. Side angle rails 42 and 44 are fixed to the respective flanges 46 and 48 of member 40. Front and back pairs of trolley wheels 50 and 52 are fixed to respective transverse shafts 54 and 56 which are rotatably journaled in pairs of bearing blocks 58 and 60 bolted to the respective angle rails 42 and 44. As best seen in FIG. 3, the trolley wheel carriage structure, above described, positions the front and back pairs of trolley wheels 50 and 52 for rolling engagement along the lengths of trolley rails 28 and 30.

A forming roller support structure 62 is fixed transversely atop the angle rails 42 and 44 and includes a pair of inverted side U-members 64 and 66 the lower ends of which are fixed as by welding to the respective angle rails 42 and 44. Front and back elongated draw bolts 68 and 70 connect between the top ends of inverted U-members 64 and 66. Both ends of each draw bolt 68 and 70 are threaded at 72 for the reception of pairs of positioning and lock nuts 74 and 76.

A lower drive shaft 78 and an upper driven shaft 80 span the support structure 62 and extend through respective cylindrical bearing assemblies generally indicated at 82 and 84 fixed as by welding to respective pairs of opposed lower and upper support blocks 86, 88 and 90, 92. The lower blocks 86, 88 being fixed as by bolts 94 relative to the central openings 95 of the inverted U-members 64 and 66. The upper blocks 90, 92 are slidable between pairs of opposed side rails 93 bolted to members 64, 66. Pairs of set screws 95 threaded through top ledges 97 position the upper blocks 90, 92. A pair of forming rollers 98 and 99 are fixed to the respective shafts 78 and 80 between the U-members 64 and 66 with their peripheral surfaces 100 and 102 in rolling contact, the set screws 96 being adjustable to maintain a proper contact between said peripheral surfaces 100 and 102.

A variable speed motor 104 is mounted on a platform 106 fixed to peripheral support members 108 fixed about the bottom end of the carriage frame 14 and a drive chain 110 is drivingly engaged between the motor sprocket 112 and a sprocket 114 fixed to an extended end of the drive shaft 78. A one-to-one gear drive is provided from drive shaft 78 to the driven shaft 80 by the gears 114 and 116 fixed to the respective shafts to drive the forming rollers 98 and 99, which are also of one-to-one ratio in opposite directions.

Guide rod support structures 120, 122 extends upwardly from top rails 20 and 22 adjacent both ends thereof. Each support structure 120, 122 is comprised of two upright members 124, 126, fixed to rails 20, 22, and a transverse member 128 spanning the top ends thereof. A pair of elongated guide rods 130, 132 are fixed between support structures 120, 122 in a longitudinal parallel relation on opposed sides of the contact point of the forming rollers 98 and 99.

A plurality of sliding extrusion support bars 134 are slidingly engaged by means of appropriate holes along guide rods 130, 132, each adjoining pair thereof and the front transverse member 126 being interconnected by flexible connection means 136 such as a chain. Therefore, the supports 134 are movable from a stacked condition, indicated in broken lines at 134' to the full line positions. A like plurality of interconnected extrusion supports 137 are connected to the back side of the roller support structure 62 which function along the rear portion of the rods 130, 132 in the same manner as supports 134 function along the front portion thereof.

A pneumatic cylinder 140 is fixed at its closed end 141 to the forward cross member 24 and extends rearwardly therefrom, the piston 142 of cylinder 140 extends rearwardly therefrom to a point of connection 144 to the carriage frame 14. A conduit 146 from a compressed air source is connected to the closed end 141 of the cylinder and a manually operated pressure regulator 148 is interposed in conduit 146.

Figure 2:
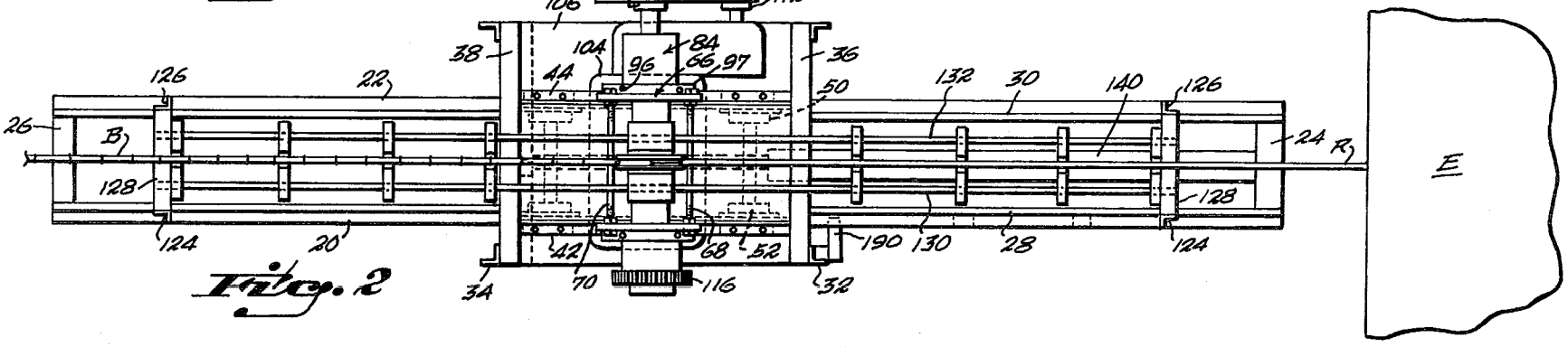
FIG. 2 is a top plan view of FIG. 1.
Figure 4:
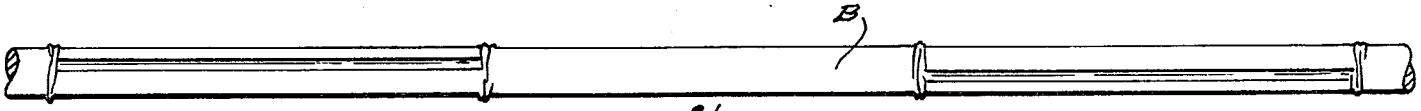
FIGS. 4 and 5 are views depicting two different typical rods formed by the device of the present invention.
Figure 5:
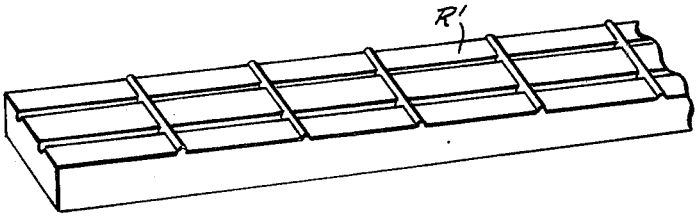

With particular reference to FIGS. 1 and 2 a conventional extruder is indicated generally at E with a rod R being extruded therefrom. It should be particularly noted that the metal forming device is aligned relative to the extruder so as to receive the extruded rod R between the forming rollers 98 and 99 on a direct line from the extruder E. In the example illustrated in the drawings, the forming rollers 98 and 99 are peripherally matingly grooved as at 150, 152 to define a bamboo design D, FIG. 4, on the extruded rod R as it passes therebetween. This design is by way of example only. For example, FIG. 5 illustrates a rod R', generally rectangular in cross section with a design 154 formed in one surface thereof. A wide variety of cross sectional configurations may be formed by the device of the present invention with designs completely therearound or on one or more surfaces thereof.

The two forming rollers 98, 99 are maintained in a proper rolling contact relative to each other by the pairs of set screws 96 threaded through the outwardly extended ledges 97 fixed respectively across inverted U-members 64, 66 above the upper support blocks 90, 92 of upper forming roller shaft 80. The guide rails 93 are fixed by screws 172 to members 64, 66 along the respective sides of each block 90, 92 to confine the upper blocks 90, 92 and upper roller shaft 80 to vertical movment.

Figure 6:
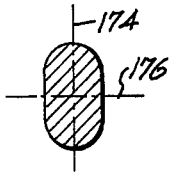
FIG. 6 is a view illustrating the general cross sectional configuration of an extrusion prior to passing between the forming rollers.

FIG. 6 illustrates the general cross sectional configuration of the extrusion R as it emerges from the extruder and passes to the forming rollers 98, 99 to form the generally round bamboo design B. The extrusion R is out of round having a vertical major axis 174 substantially longer than the minor horizontal axis 176.

As the extrusion moves toward the forming rollers it first engages the sliding supports 134 in the stacked condition which sequentially move to the spaced apart full line positions with the extrusion movement to maintain a relatively closely spaced support as the forming operation progresses. The sliding supports 137 function in the same manner, moving sequentially from a stacked condition adjacent the support structure 62 as the formed rod emerges from the forming rollers 98, 99.

The forces involved in the functioning of the device are variable, depending upon various factors determined by individual materials and types of extrusions. By way of example only, the P.S.I. of the extrusion is controllable by control means 180 on the extruder E to maintain a range between six and twelve P.S.I., the pressure being exerted toward the back of the device 10 as indicated by the arrow 182. The air pressure to cylinder 140 is regulated to 10 P.S.I. by the pressure regulator 148, this pressure also being exerted toward the back of the device 10, by piston rod 142, indicated by arrow 184, and the motor 104 is set to drive the forming rollers at twenty RPM. For example, if the forces of extrusion R remains constant at nine P.S.I., the forces exerted on the extrusion by the forming roller speed will balance the combined P.S.I. of the extrusion R and the ten P.S.I. of the piston 142 and the carriage trolley 14 would remain substantially stationary in the central portion of the fixed frame 12. If the extrusion pressure drops to six P.S.I., the carriage trolley will drift forwardly toward the extruder. If the extrusion pressure increases to 12 P.S.I., the carriage trolley 14 will drift rearwardly. Normally, the carriage trolley will drift forwardly and rearwardly within a range of approximately three feet of travel preventing buckling or stretching of the extrusion such as occurs with similar P.S.I. fluctuations when the forming rollers are in a fixed position. If the carriage trolley 14 advances forwardly until a trip arm 190 fixed thereto contacts an "off" switch 192 to motor 104, the carriage trolley 14 immediately reverses its direction of travel for a short distance until the trip arm 190 contacts a "motor on" switch 194. The extruder operator may decrease the extrusion P.S.I. temporarily by the extruder control means 180 to decrease the extrusion P.S.I. if the pressure remains too great for a sufficient period of time to cause the carriage trolley 14 to approach the rear end of the fixed frame 12.

What is claimed is:

1. A device for imparting a continuous decorative design to a metallic extrusion as it emerges outwardly from an extruder in a relatively soft condition in a continuous rod form along a generally straight path of travel, and under the influence of a predetemined range of fluctuating outwardly directed pressure forces, said device comprising, an elongated fixed frame including track means in a generally parallel relation to the straight path and including a forward end adjacent the extruder and a rear end, a carriage trolley including wheel means for engagement on said track means for movement toward and away from the extruder, upper and lower forming rollers, having one-to-one ratio, rotatably mounted on said carriage trolley in a peripheral rolling engagement with each other, at least one of said rollers being peripherally grooved with desired design characteristics formed in said groove, said forming rollers being positioned for passage of the continuous rod therebetween through said groove as it emerges from the extruder to impart the cross sectional shape of said groove and said design characteristics along the length of said extrusion, means to exert a predetermined amount of outwardly directed pressure forces against said carriage trolley, means to drive said forming rollers in predetermined opposite directions at alike predetermined numbers of revolutions per minute to substantially counter the combined outwardly directed forces of the continuous rod extrusion and said means to exert while permitting said carriage trolley to drift sequentially forwardly and backwardly in direct response to decreasing and increasing force fluctuations.

2. The device as defined in claim 1 wherein said means to exert comprises a pneumatic cylinder and piston assembly, operable from a compressed air source, and being connected between said fixed frame and carriage trolley.

3. The device as defined in claim 2 including a pressure regulator control and an air conduit connecting between the source and said pneumatic cylinder with said regulator control interposed in said conduit.

4. The device as defined in claim 1 wherein said elongated fixed frame includes a pair of spaced apart longitudinally extending parallel top rails supported on end leg means, said track means comprising a pair of upwardly extending tracks fixed in a parallel relation along said top rails.

5. The device as defined in claim 4 wherein said carriage trolley comprises a generally cubical frame and said wheel means comprises front and back pairs of wheels carried respectively on front and back axles, said cubical frame including an enlarged portion suspended beneath said top rails and a top portion including front and back pairs of journal blocks to rotatably journal said front and back wheel axles.

6. The device as defined in claim 5 wherein said means to drive includes a variable speed electric motor mounted within said enlarged suspended portion.

7. The device as defined in claim 6 including an upwardly extending forming roller support structure fixed atop said top portion with a pair of spaced apart upstanding side portions, and upper and lower transverse shafts rotatably journaled between said side portions carrying the upper and lower forming rollers in respective fixed relations thereto.

8. The device as defined in claim 7 wherein said means to drive includes a chain and sprocket drive connection between said motor and lower transverse shaft, and a drive gear connection having a one-to-one ratio between said upper and lower transverse shafts.

9. The device as defined in claim 7 including means to maintain said rolling contact between said upper and lower forming rollers.

10. The device as defined in claim 9 wherein said means to maintain comprises a pair of slide block journals engaged by the respective opposite ends of said upper transverse shaft, a vertical slideway fixed relative to each of said upstanding side portions for sliding engagement by one of said slide blocks, an upper projection from each of said upstanding side portions above said slide block and set screw means extending through each of said projections into engagement with one of said slide blocks.

11. The device as defined in claim 1 including a peripheral groove in both of said forming rollers, each groove defining one side-half of said decorative design imparted to said continuous rod as it passes between said forming rollers through said grooves.

12. The device as defined in claim 6 including an "off" switch for said electric motor fixed to said fixed frame adjacent said forward end thereof, and an "on" switch for said electric motor fixed to said fixed frame somewhat rearwardly of said "off" switch, and a trip arm, fixed to said carriage trolley in a position to contact and actuate said "off" and "on" switches sequentially when said carriage trolley is moved forwardly and rearwardly.

13. The device as defined in claim 1 including a pair of elongated guide rods rigidly supported between forward and rear support structures, fixed adjacent to and extending upwardly from the respective forward and rear ends of said fixed frame, said rods being disposed in parallel relation on opposed sides of said straight path.

14. The device as defined in claim 13 including a first plurality of extrusion support bars slidably engaged along and spanning the distance between said guide rods forwardly of said carriage trolley, and including flexible connection means of predetermined lengths, such as chains, between each adjacent pair thereof and said forward support structure.

15. The device as defined in claim 14 including a second plurality of extrusion support bars slidably engaged along and spanning the distance between said guide rods rearwardly of said carriage trolley, and including flexible connection means of predetermined lengths, such as chains, between each adjacent pair thereof and said carriage trolley.

* * * * *